US008459494B2

(12) United States Patent
Dewinetz

(10) Patent No.: US 8,459,494 B2
(45) Date of Patent: Jun. 11, 2013

(54) APPARATUS FOR SHADING A BEVERAGE CONTAINER

(76) Inventor: Cory Dewinetz, Langley (CA)

( * ) Notice: Subject to any disclaimer, the term of this patent is extended or adjusted under 35 U.S.C. 154(b) by 0 days.

(21) Appl. No.: 12/189,427

(22) Filed: Aug. 11, 2008

(65) Prior Publication Data

US 2009/0107860 A1 Apr. 30, 2009

Related U.S. Application Data

(60) Provisional application No. 60/954,932, filed on Aug. 9, 2007.

(51) Int. Cl.
*B65D 25/00* (2006.01)

(52) U.S. Cl.
USPC ..... 220/737; 220/703; 220/694; 206/217

(58) Field of Classification Search
USPC ..... 220/739, 740, 741, 737, 903, 738, 220/694, 703; 215/376; 229/5.5; D7/396.2; 206/217
See application file for complete search history.

(56) References Cited

U.S. PATENT DOCUMENTS

| | | | | | |
|---|---|---|---|---|---|
| 349,589 | A | | 9/1886 | King | |
| 1,910,168 | A | * | 5/1933 | Jacobs | 294/142 |
| 2,328,367 | A | * | 8/1943 | Augustine | 220/737 |
| 3,062,430 | A | * | 11/1962 | Rutledge | 229/152 |
| 3,080,050 | A | * | 3/1963 | Fielding | 206/431 |
| D264,927 | S | * | 6/1982 | Kurzius | D7/622 |
| 4,382,506 | A | * | 5/1983 | Chaussadas | 206/200 |
| D291,065 | S | * | 7/1987 | Pugh | D9/418 |
| D304,670 | S | * | 11/1989 | Johnson | D8/71 |
| 4,895,259 | A | * | 1/1990 | Paley | 206/565 |
| 4,993,675 | A | * | 2/1991 | Walker | 248/311.2 |
| 5,533,639 | A | * | 7/1996 | Myers | 220/23.8 |
| D379,905 | S | * | 6/1997 | Cusanelli | D7/619.1 |
| 6,237,766 | B1 | * | 5/2001 | Hollingsworth | 206/320 |
| 6,412,663 | B1 | * | 7/2002 | Adamson et al. | 222/183 |
| 6,554,155 | B1 | * | 4/2003 | Beggins | 220/739 |
| 6,637,447 | B2 | | 10/2003 | McMullin | |
| D629,247 | S | * | 12/2010 | Dewinetz | D7/396.2 |
| D636,635 | S | * | 4/2011 | Dewinetz | D7/396.2 |
| 2006/0138155 | A1 | * | 6/2006 | Kratz | 220/737 |

* cited by examiner

*Primary Examiner* — Mickey Yu
*Assistant Examiner* — Kareen Rush
(74) *Attorney, Agent, or Firm* — Adrian D. Battison; Ade & Company Inc.

(57) ABSTRACT

A shaped Styrofoam insulated sheet for shading a beverage container has fold lines thereacross to define a bottom coaster portion for resting on flat surface and shaped for supporting a base of the beverage container, an upstanding piece along one side of the beverage container shaped to follow a side elevation of the beverage container to act as a shade the beverage container and an upwardly inclined top cover piece extending over the beverage. The upstanding piece is bottle or glass shaped and carries advertising printed on the outside surface or inserted as a sheet into a transparent envelope.

6 Claims, 3 Drawing Sheets

APPARATUS FOR SHADING A BEVERAGE CONTAINER

This application claims the benefit under 35 USC 119 of Provisional Application 60/954,932 filed Aug. 9, 2007.

This invention relates to an apparatus for shading a beverage container.

BACKGROUND OF THE INVENTION

U.S. Pat. No. 6,637,447 (McMullin) issued Oct. 28, 2003 discloses an umbrella type device which clips onto the side of a bottle and provides a sun shade over the bottle for keeping the beverage shaded.

U.S. Design Pat. No. 394,589 (King) issued May 26, 1998 discloses a similar umbrella type device which is carried on a base having receptacles for beer bottles and provides a sun shade over the bottle for keeping the beverage shaded.

Neither of these devices has been successful and neither is convenient for packaging or supply as a simple inexpensive item which has significant opportunities for product promotion and also provide the customer with a useful device.

SUMMARY OF THE INVENTION

It is one object of the invention to provide an apparatus for shading a beverage container.

According to one aspect of the invention there is provided an apparatus for shading a beverage container comprising:

a sheet which includes fold or bend lines thereacross at spaced positions therealong to define:

a coaster portion for resting on flat surface and supporting a base of the beverage container;

a generally upstanding piece along one side of the beverage container shaped to shade the beverage container;

and a top cover piece arranged to extend at an angle to the upstanding piece to extend over the beverage container.

The sheet may be formed of an insulating foam material such as Styrofoam in a flat pack shape and bent to the required positions by the end user. Alternatively the product may be formed from molded plastics such as acrylic into the required shape.

Preferably the upstanding piece is shaped to generally follow the shape of the beverage container in side elevation, such as a beer glass, bottle, wine glass or martini glass.

Preferably the coaster has a curved edge opposite the upstanding piece so as to define a curve generally following an outer edge of the beverage container.

Preferably the width of the upstanding piece at the coaster is equal to the width of the coaster.

Preferably the width of the upstanding piece at the top piece is equal to the width of the top piece.

Preferably the top piece is inclined upwardly and over the coaster.

Preferably the upstanding piece carries printed advertising as a printed layer on an outer surface thereof.

Preferably the upstanding piece carries a layer of transparent sheet material on the outer surface to receive printed advertising as an insert sheet.

The invention also includes as a separate aspect a combination of a beverage container and an apparatus for shading the beverage container, the apparatus comprising:

a sheet which includes fold or bend lines thereacross at spaced positions therealong to define:

a coaster portion for resting on flat surface and supporting a base of the beverage container;

a generally upstanding piece along one side of the beverage container shaped to have a front elevation which matches in shape a side elevation of the beverage container so as to shade the beverage container;

and a top cover piece inclined upwardly and across a top of the beverage container.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
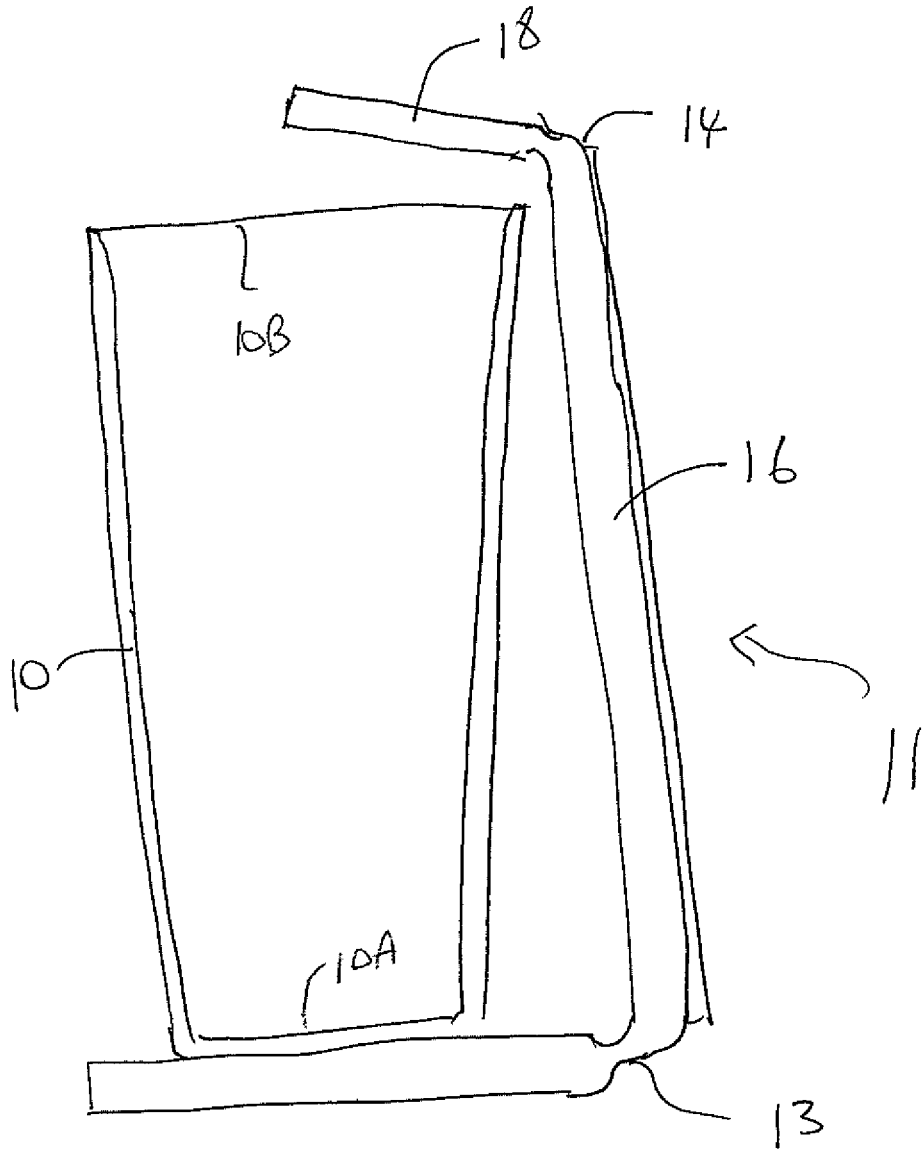
FIG. 1 is a side elevational view of a combination of a beverage container and shading apparatus according to the present invention.

In FIG. 1 is shown a beverage container in the form of a beer glass of the conventional tapered shape which has a peripheral wall 10C which increases in width from a circular base 10A to a circular open top 10B.

Figure 2:
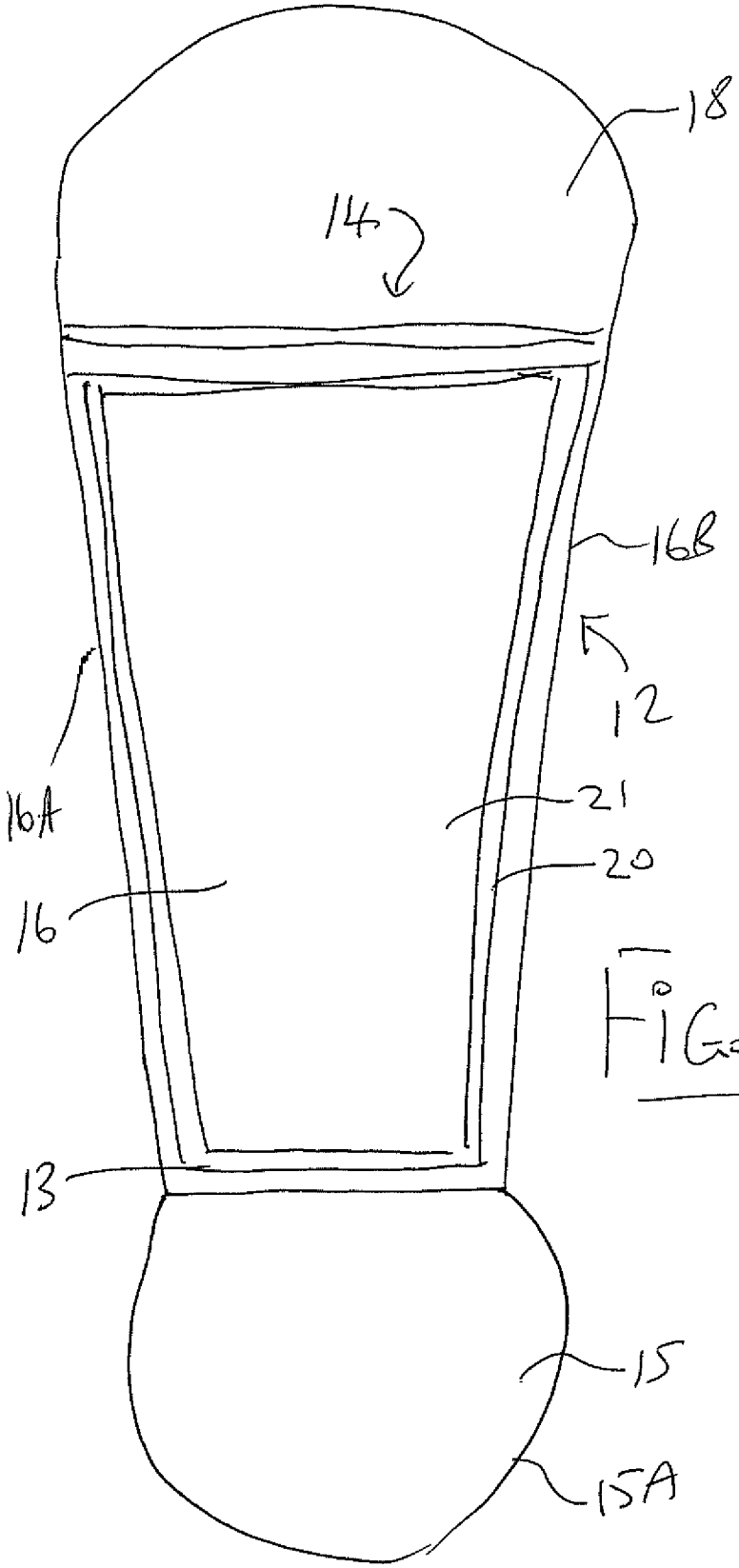
FIG. 2 is a front elevational view of a blank forming the shading apparatus of FIG. 1.

The apparatus 11 for shading the beverage container in a first embodiment is formed of a flat sheet 12 of a foam material, shown in FIG. 2, which includes weakened bend lines 13 and 14 thereacross at spaced positions therealong. Typically such bend lines are formed by compressing the foam material at the required bend line while the foam material remains as a flat blank to be bend into the required shape when required to be used.

The bend lines and the outer shape of the blank are shaped to define a generally circular coaster portion 15 at one end for resting on flat surface and supporting the base of the beverage container. The fold or bend line 13 separates the coaster from an upstanding piece 16 which when bent from the flat blank extends along one side of the beverage container and is shaped to match the general shape of the glass 10 and thus to shade the glass 10. Thus the upstanding piece joins the coaster portion at a chord line across the generally circular coaster portion where the chord line is defined by the bend 13.

The coaster 15 has a curved edge 15A opposite the chord line 13 at the bottom of the upstanding piece so as to define a curve generally following an outer edge of the base of the glass 11, but preferably slightly larger than the base so as to receive the circular base stably resting on the coaster portion.

The second fold line 14 parallel to the first separates the upstanding piece from a top cover piece 18.

The upstanding piece 16 is shaped with side edges 16A and 16B to generally follow the shape of the glass in side elevation and thus is similarly tapered.

The width of the upstanding piece 15 at the coaster is equal to the coaster since they are joined at the chord fold line 13. However the chord is spaced from a diameter so that the width of the coaster portion increases from the chord. Similarly the width of the upstanding piece at join line 14 to the top piece is equal to the width of the top piece.

The fold line 14 is arranged so that the top piece is inclined upwardly and inwardly over or across the coaster to lie over the glass to provide shading of the top of the glass. As shown the top piece extends only partly across the top 10B and has a generally curved outer edge spaced form the fold line 14. Such a shape is generally sufficient to shade the top 10B since the sun is commonly at an angle and only rarely directly overhead. However the top piece may be shaped to match the size and shape of the top 10B.

The flat form of the foam material, such as Styrofoam which is indented to form the weakened lines at which it can be bent, allows the product to be supplied as a cheap insert supplied in a flat pack or as a stack of such products.

The upstanding piece carries printed advertising or other printed material for an attractive appearance or for advertising the drinks with which the device is to be used in a bar or the like. This can be applied directly as a printed layer on an outer surface thereof. Alternatively the upstanding piece carries a layer of transparent sheet material 20 on the outer surface to receive printed advertising as an insert sheet 21.

Figure 3:
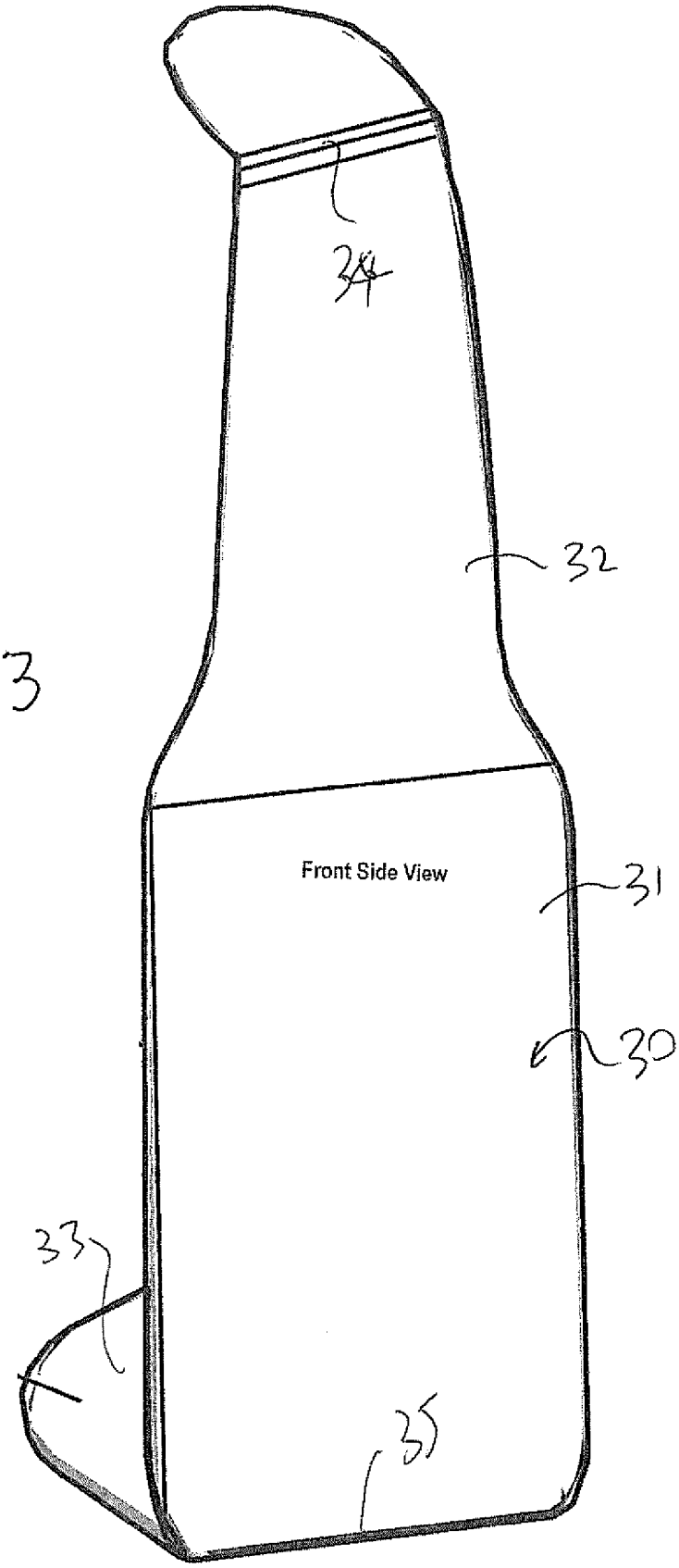
FIG. 3 shows an alternative shape of blank which can be used with beverage containers such as a bottle.

As shown in FIG. 3, the upstanding piece is bottle shaped so as to define a bottom portion 31 connected to the coaster portion 33 at a bend line 35 which is generally rectangular and an upper portion 32 which has tapered sides to a top bend line 34. The top portion 36 is much smaller than the coaster portion 33 since the top of the bottle is generally small in diameter.

Other shapes of the upstanding portion can be used in conjunction with suitably sized coaster portion and top piece to match other shaped containers such as an arrangement where the upstanding piece is wine glass shaped or martini glass shaped.

As an alternative to the flat foam product, the product may be injection molded from a rigid plastics to the required shape. The molded to shape product can thus be more expensive and intricate in structure so as to be sold as a pack of the products rather than in simple flat form.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A combination comprising:

a beverage container having a base, an upstanding peripheral wall and a top with an edge defining a top opening which is open to allow a user to drink beverage directly from the edge at the top through the open top opening;

and an apparatus for shading the beverage container, the apparatus comprising:

a rigid plastic body which includes bend lines across the body at spaced positions therealong;

the rigid plastic body defining a flat base coaster portion for resting on flat surface;

the beverage container and the coaster portion being separate and arranged such that the beverage container can be placed on the coaster portion for supporting the base of the beverage container and removed from the coaster portion for drinking of the beverage;

the rigid plastic body defining a generally upstanding piece along one side of the peripheral wall of the beverage container shaped to have a front elevation which generally matches in shape a side elevation of the beverage container so as to shade the beverage container;

the generally upstanding piece being arranged so that an upper edge thereof is at or adjacent the top of the beverage container;

and the rigid plastic body defining a top cover piece, attached to the upper edge of the generally upstanding piece, and inclined upwardly and across the edge and top opening of the top of the beverage container;

the top cover piece being shaped so as to provide shade to at least part of the edge and the top opening of the top of the beverage container.

2. The combination according to claim 1 wherein the coaster portion has a generally circular curved edge opposite the upstanding piece with the coaster portion being connected to the upstanding piece at a chord across the circular outer edge of the coaster portion with the width of the upstanding piece at the coaster being equal to the length of the chord across the coaster portion.

3. The combination according to claim 1 wherein the width of the upstanding piece at the top piece is equal to the width of the top piece.

4. The combination according to claim 1 wherein the upstanding piece increases in width from the coaster portion to the top piece to follow a tapered shape of a beer glass.

5. The combination according to claim 1 wherein the upstanding piece includes a lower generally rectangular portion and an upper portion which decreases in width from the top of the rectangular portion to the top piece to generally follow a bottle shape.

6. The combination according to claim 1 wherein the upstanding piece carries printed advertising as a printed layer on a front surface thereof.

* * * * *